US008106334B2

(12) United States Patent
Nam

(10) Patent No.: US 8,106,334 B2
(45) Date of Patent: Jan. 31, 2012

(54) ELECTRIC OVEN HAVING CONVECTION COVER FORMED WITH SUB-OUTLETS

(75) Inventor: Hyeun Sik Nam, Seoul (KR)

(73) Assignee: LG Electronics Inc., Seoul (KR)

( * ) Notice: Subject to any disclaimer, the term of this patent is extended or adjusted under 35 U.S.C. 154(b) by 723 days.

(21) Appl. No.: 12/222,586

(22) Filed: Aug. 12, 2008

(65) Prior Publication Data

US 2009/0045184 A1 Feb. 19, 2009

(30) Foreign Application Priority Data

Aug. 14, 2007 (KR) ..... 10-2007-0081911

(51) Int. Cl.
*A21B 1/26* (2006.01)

(52) U.S. Cl. ..... 219/400; 126/21 A; 99/476

(58) Field of Classification Search ..... None
See application file for complete search history.

(56) References Cited

U.S. PATENT DOCUMENTS

| | | | | |
|---|---|---|---|---|
| 3,168,642 | A * | 2/1965 | Savio | 219/400 |
| 4,283,614 | A * | 8/1981 | Tanaka et al. | 219/681 |
| 5,485,780 | A * | 1/1996 | Koether et al. | 99/419 |
| 5,801,362 | A * | 9/1998 | Pearlman et al. | 219/400 |
| 6,218,651 | B1 * | 4/2001 | Chung | 219/681 |
| 6,472,647 | B2 * | 10/2002 | Lee et al. | 219/681 |
| 6,730,881 | B1 * | 5/2004 | Arntz et al. | 219/400 |
| 7,060,940 | B2 * | 6/2006 | Kim et al. | 219/400 |
| 7,087,873 | B2 * | 8/2006 | Hayakawa et al. | 219/682 |
| 7,102,105 | B2 | 9/2006 | Oh | |
| 7,371,999 | B1 * | 5/2008 | Douglas et al. | 219/399 |
| 7,910,861 | B2 * | 3/2011 | Nam et al. | 219/400 |
| 2003/0140917 | A1 * | 7/2003 | Rummel et al. | 126/21 A |
| 2004/0129692 | A1 * | 7/2004 | Kim et al. | 219/400 |
| 2004/0222208 | A1 * | 11/2004 | Ko | 219/401 |
| 2006/0131298 | A1 * | 6/2006 | Seuk Oh | 219/400 |
| 2006/0186108 | A1 * | 8/2006 | Kim et al. | 219/400 |

FOREIGN PATENT DOCUMENTS

| | | | |
|---|---|---|---|
| EP | 1780471 | A2 * | 5/2007 |
| KR | 10-1995-9707 | | 11/1995 |
| KR | 10-2001-55388 | | 7/2001 |
| KR | 20-365631 | | 10/2004 |
| KR | 10-697022 | | 3/2007 |

* cited by examiner

*Primary Examiner* — Joseph M Pelham
(74) *Attorney, Agent, or Firm* — McKenna Long & Aldridge LLP

(57) ABSTRACT

An electric oven having a convection heater and a convection cover. The convection cover including a main outlet located at or near the periphery of the convection cover, and a sub-outlet, more centrally located near the convection heater relative to the main outlet. Together, the main outlet and the sub-outlet allow the heated air to be uniformly circulated throughout the cooking chamber and to be evenly transferred to food irrespective of the position of the food in the cooking chamber. Uniform air circulation in the cooking chamber will result in more favorable cooking results.

14 Claims, 13 Drawing Sheets

[Figure 1]
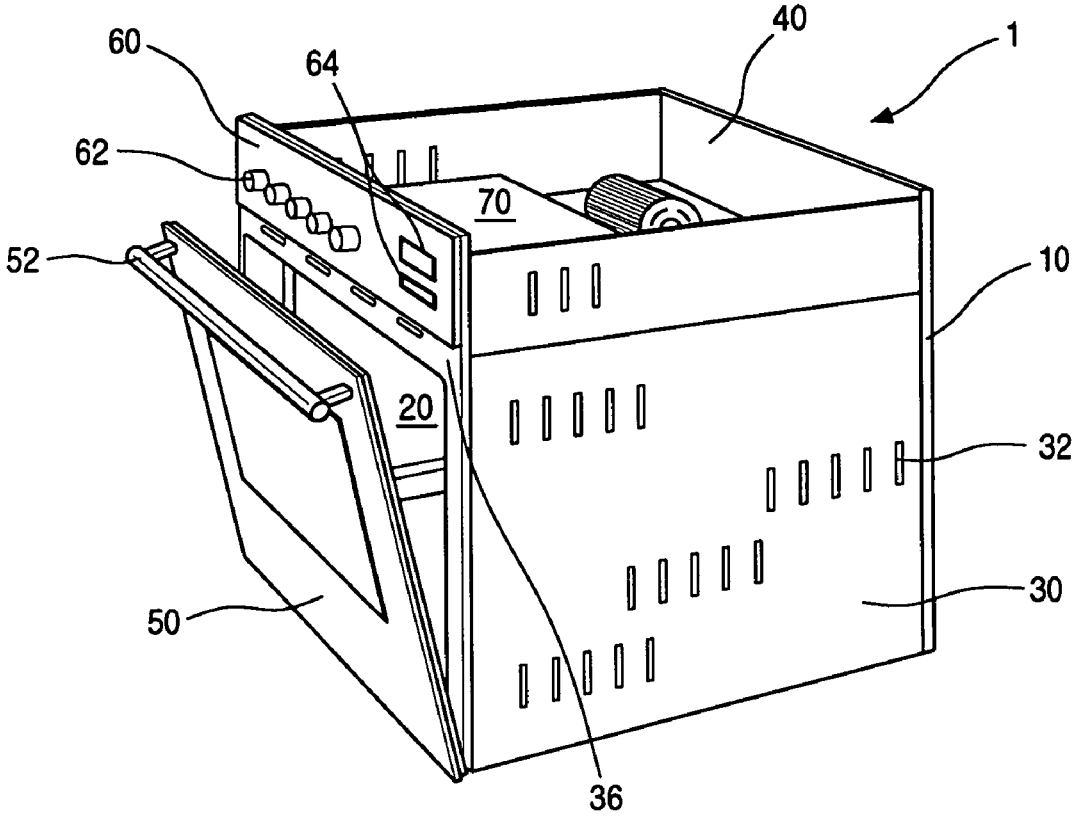

[Figure 2]
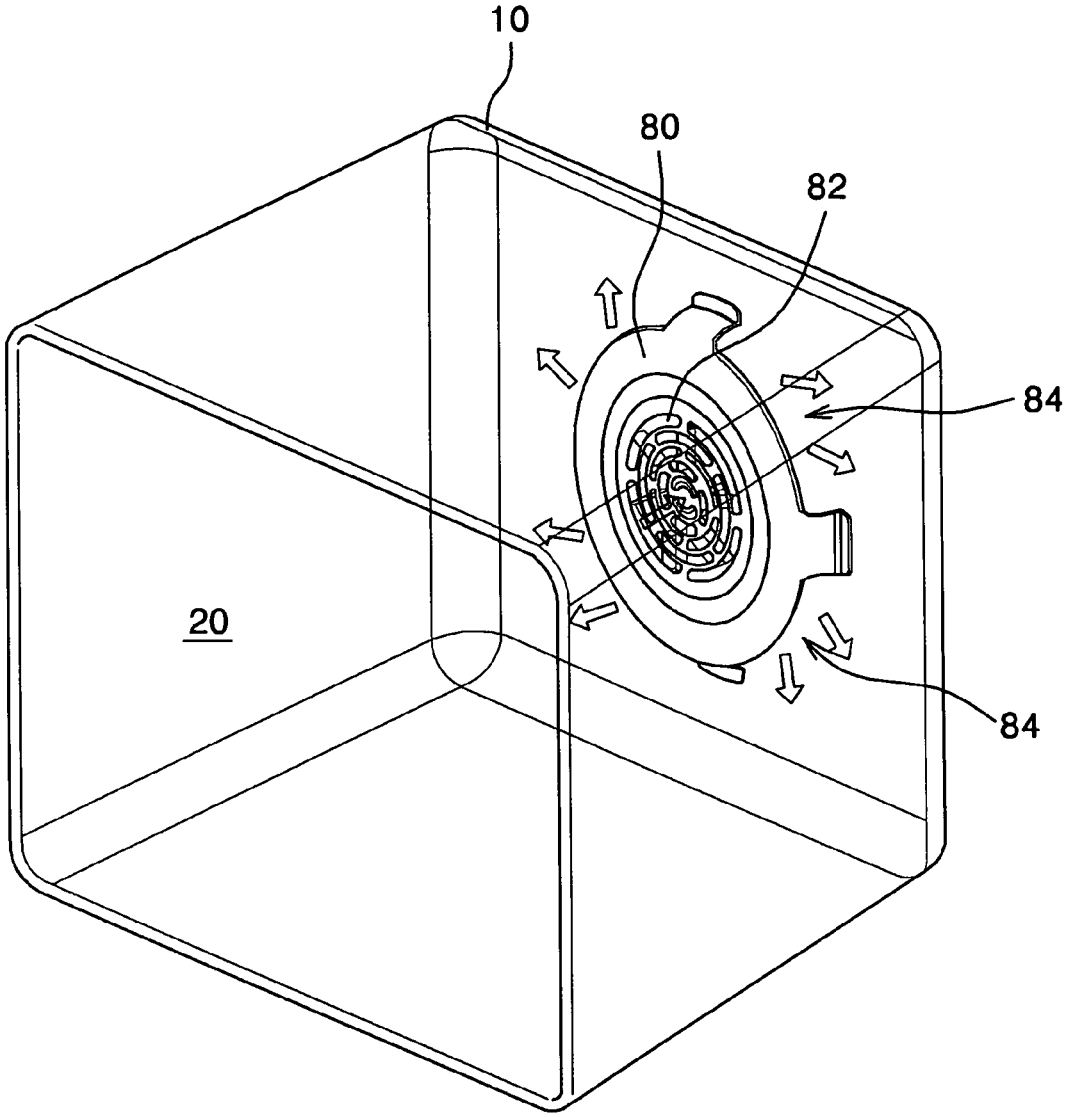

[Figure 3]
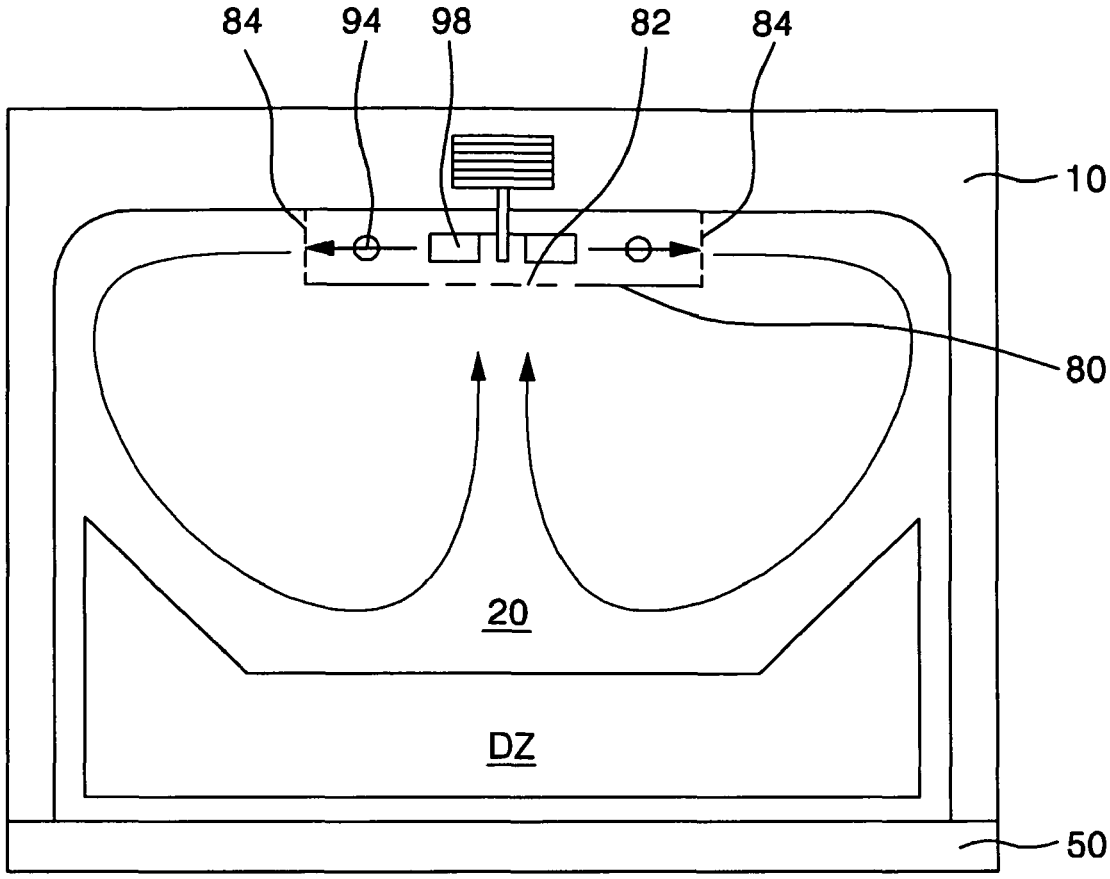

[Figure 4]
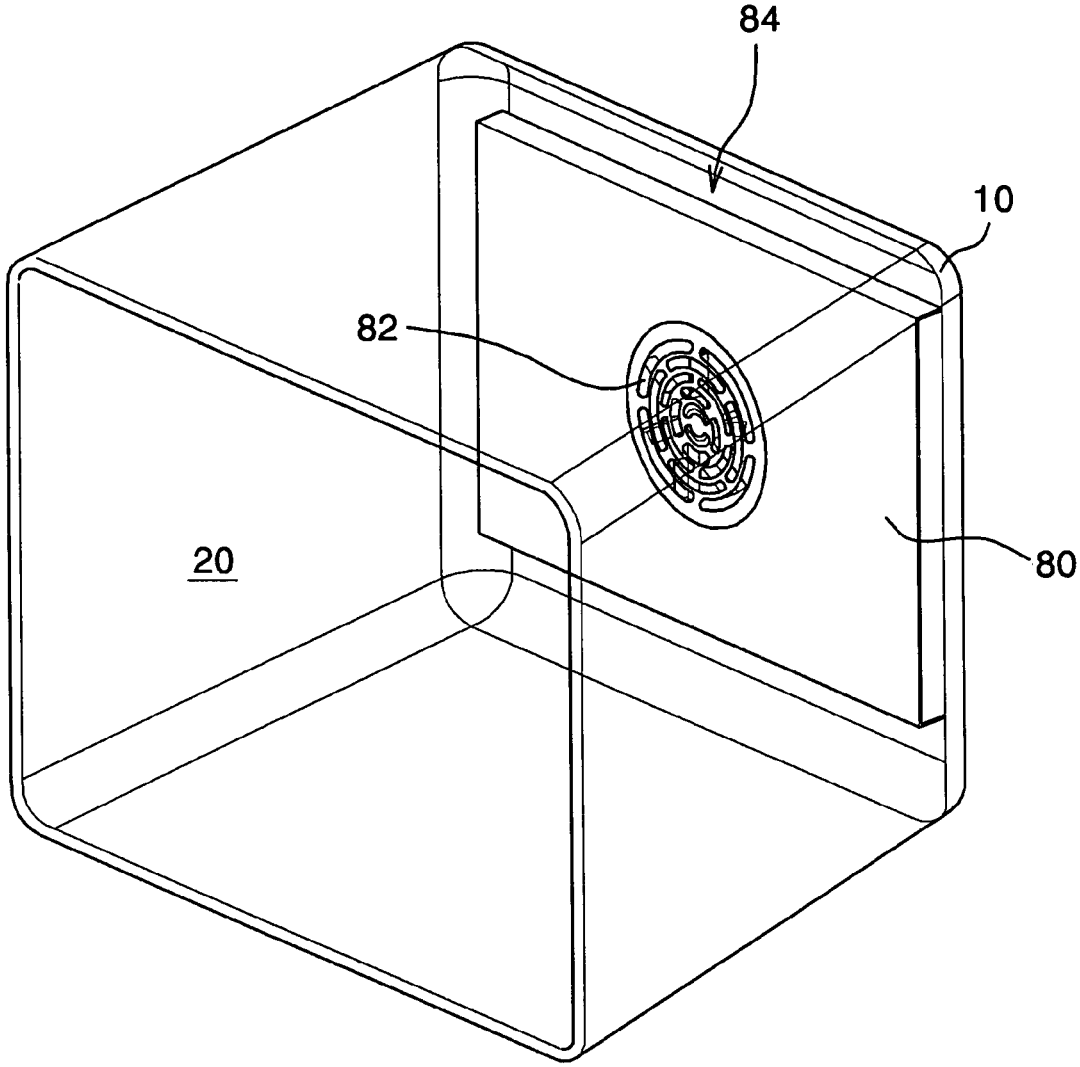

[Figure 5]
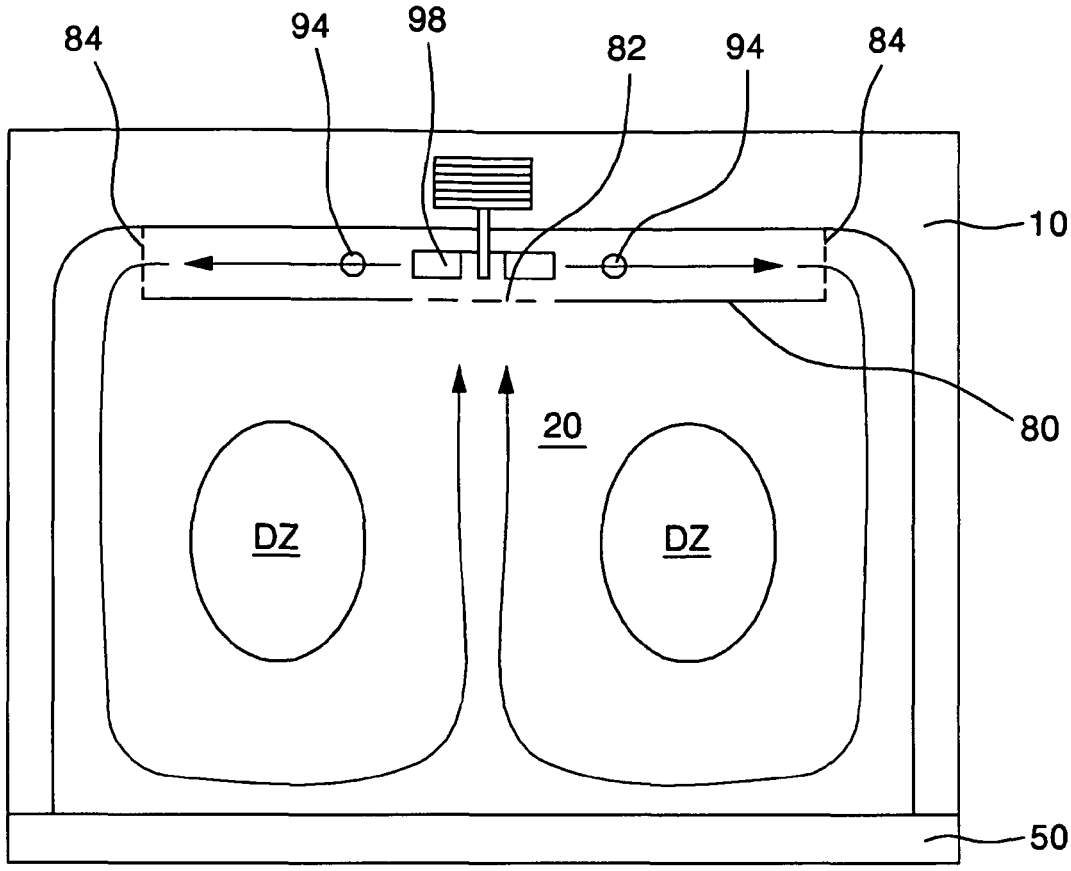

[Figure 6]
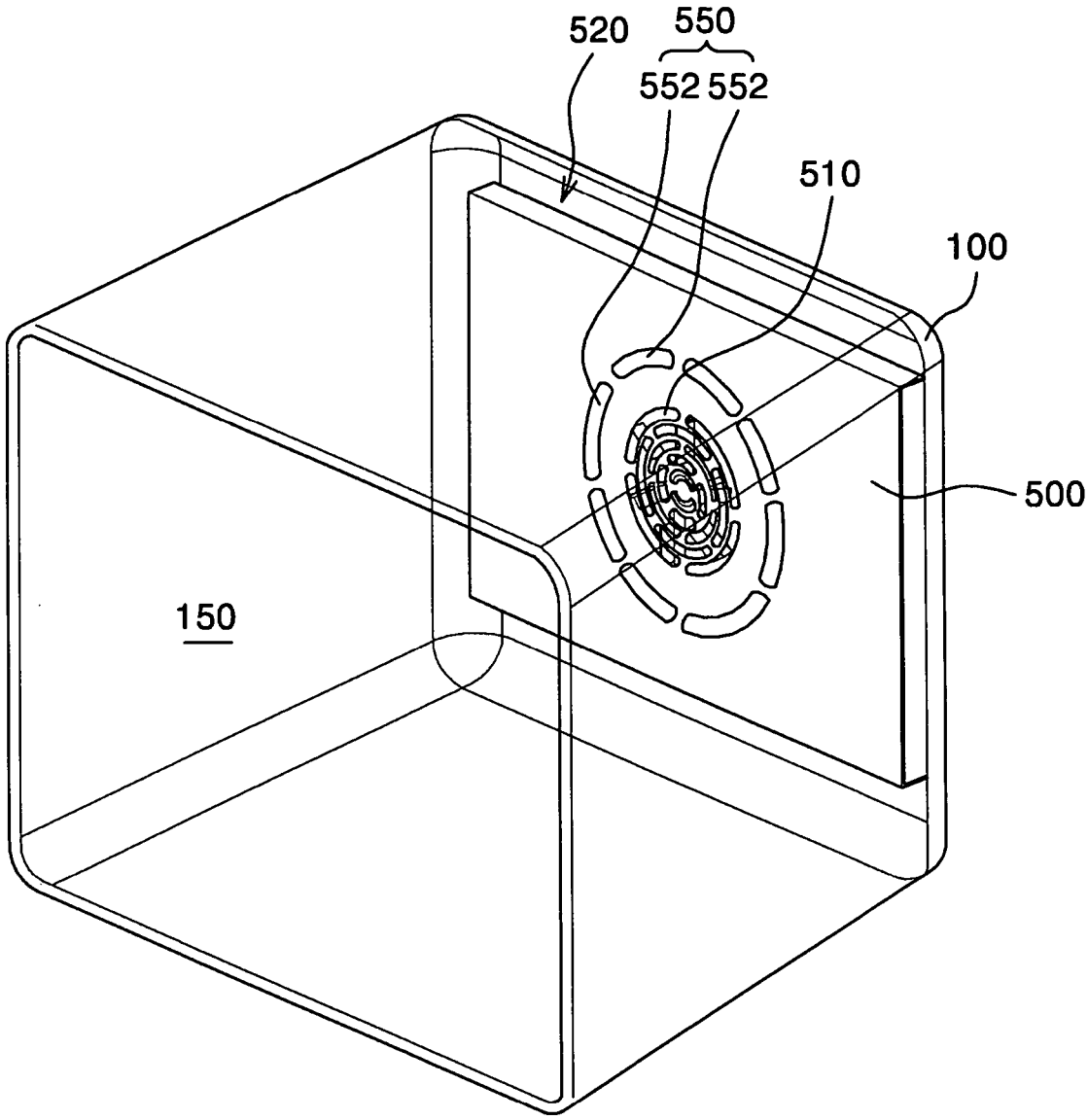

[Figure 7]
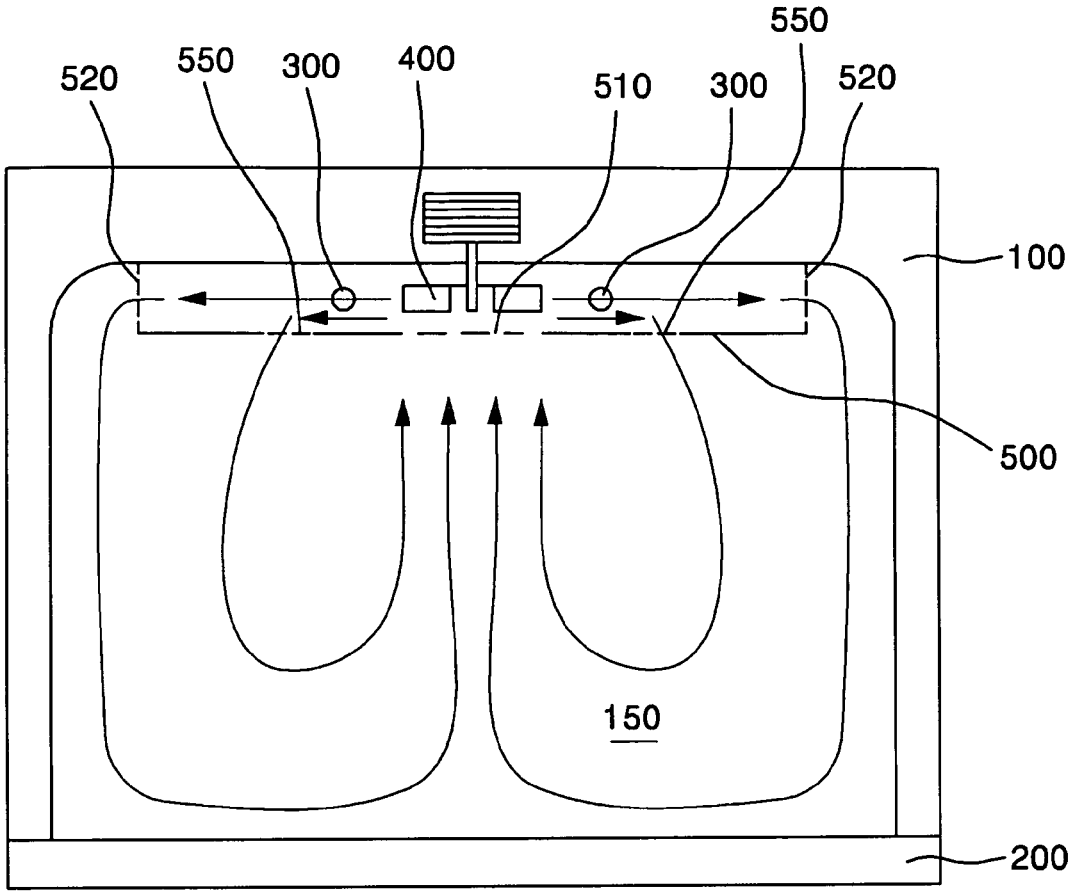

[Figure 8]
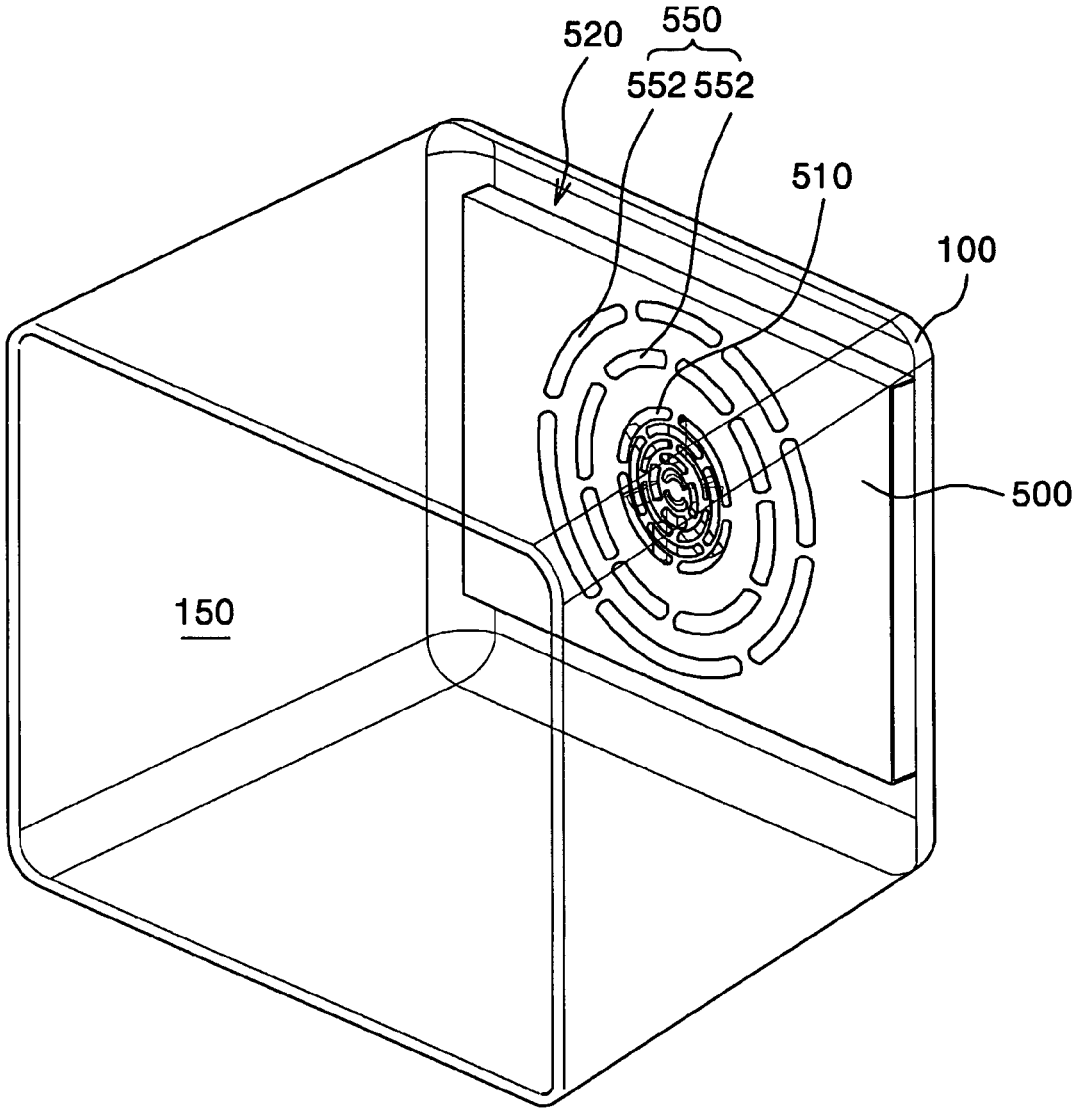

[Figure 9]
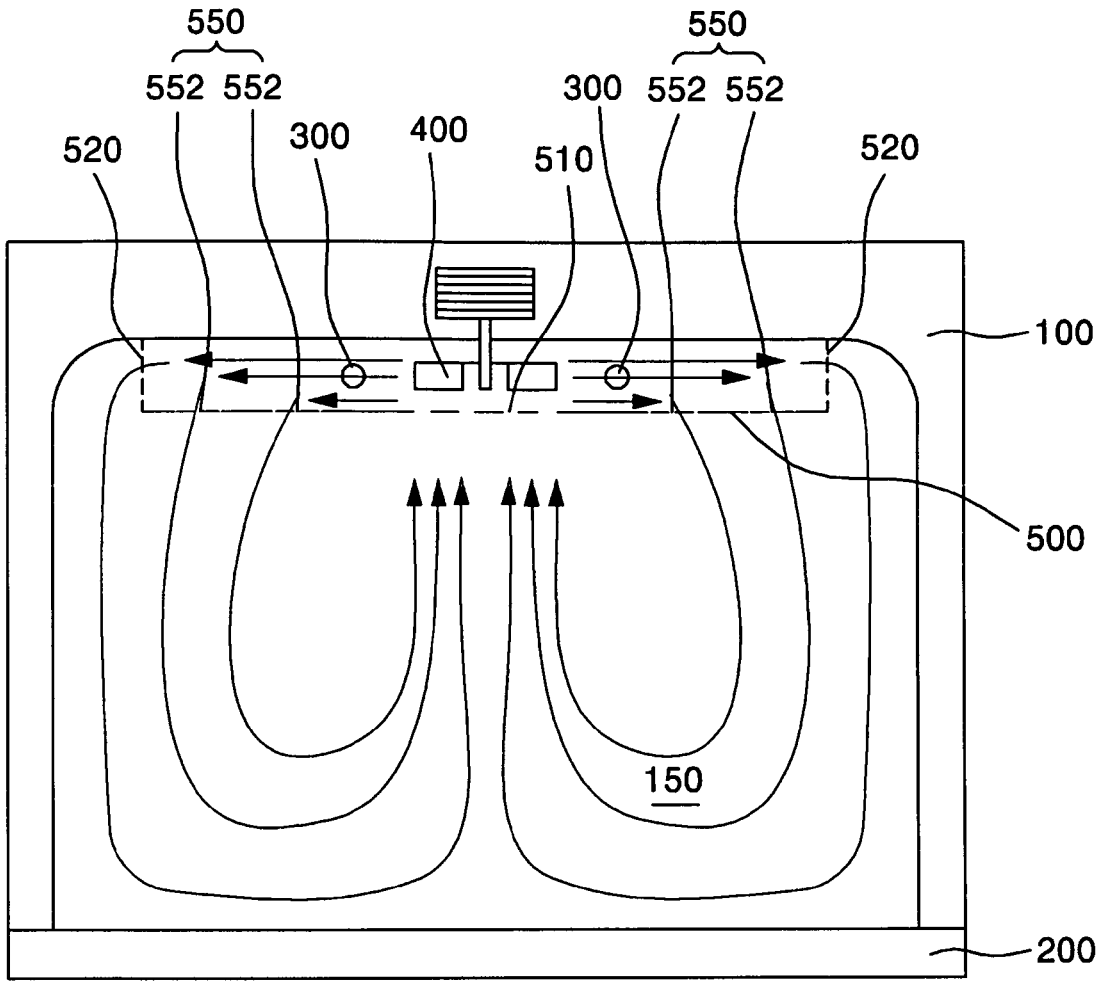

[Figure 10]
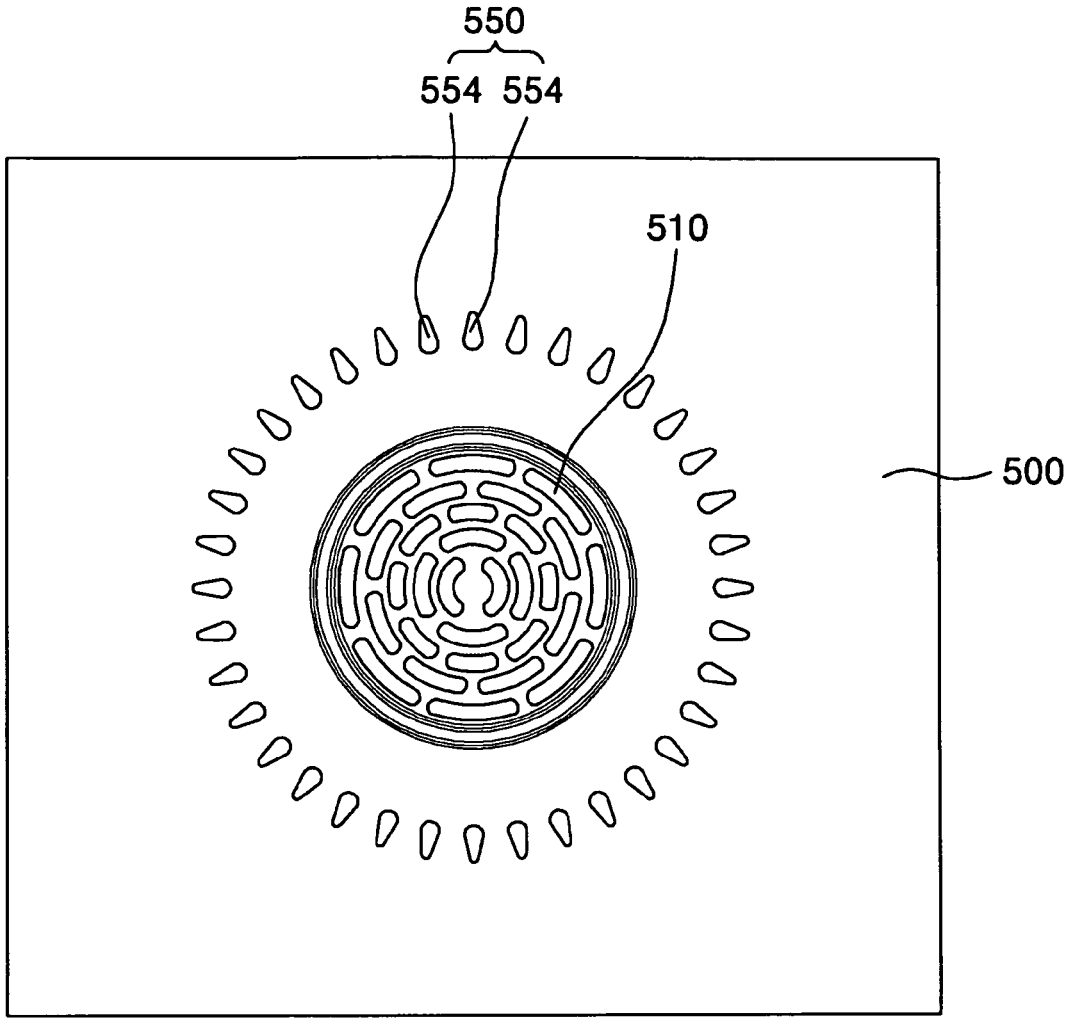

[Figure 11]
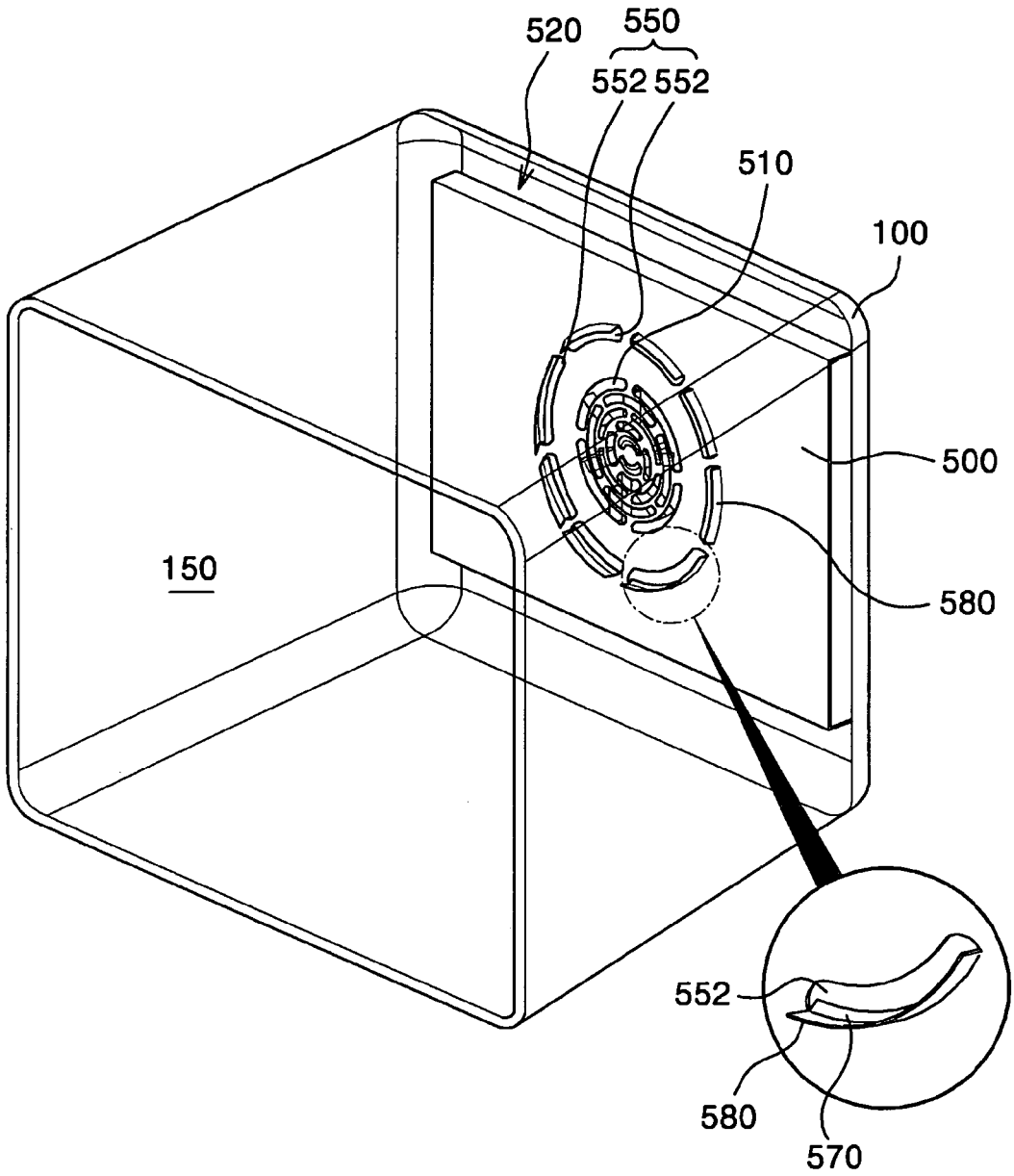

[Figure 12]
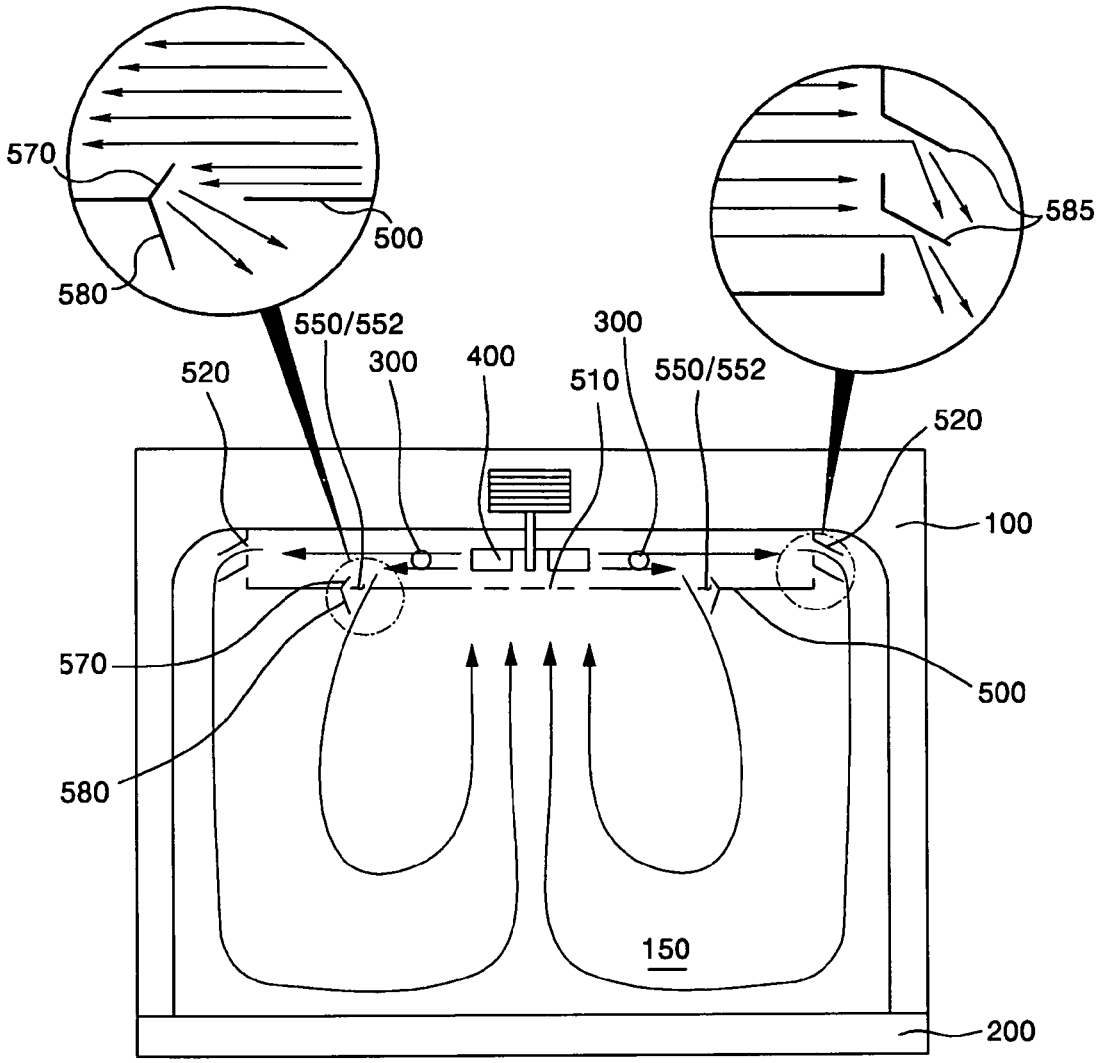

[Figure 13]
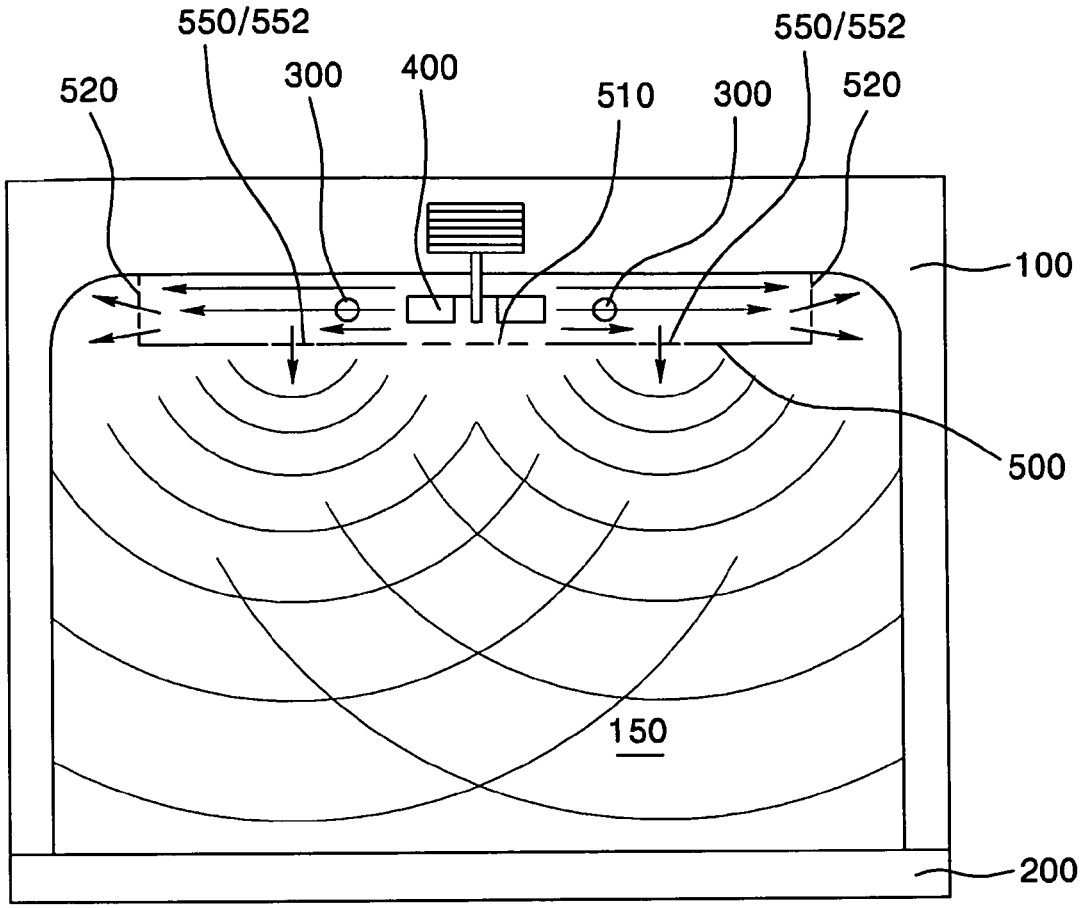

ELECTRIC OVEN HAVING CONVECTION COVER FORMED WITH SUB-OUTLETS

This application claims the benefit of Korean Patent Application No. 10-2007-0081911, filed on Aug. 14, 2007, which is hereby incorporated by reference in its entirety.

BACKGROUND OF THE INVENTION

1. Field of the Invention

The present invention relates to an electric oven, and more particularly, to an electric oven having a convection cover formed with a sub-outlet, in which heated air exhausted from the sub-outlet of the convection cover to a cooking chamber of the electric oven uniformly circulates throughout the cooking chamber to evenly transfer heat to food irrespective of its position in the cooking chamber to obtain a favorable cooking result.

2. Description of the Related Art

Generally, electric ovens are used for cooking food placed in the cooking chamber using heat generated by a ceramic heater, a sheath heater, a halogen heater or a high-frequency generating device. The food in the cooking chamber can be cooked relatively fast because inner and outer portions of the food can be simultaneously cooked. Electric ovens are also safe to use and have high thermal efficiency. Thus, the use of electric ovens is on the rise.

FIG. 1 illustrates a perspective view of a conventional electric oven which includes a six-sided body 10 enclosing a cooking chamber 20. The body 10 includes side plates 30 which form the side exterior portion of the body 10. At least one of the side plates 30 is provided with a plurality of air inlets 32 for drawing in external air to cool the body 10 and the various internal components. The body 10 also includes a rear plate 40 which forms the rear exterior portion of body 10. The front side of body 10 includes a door 50 for selectively opening and closing the cooking chamber 20. The door 50 has a rectangular shape and is hinge connected so that the door pivots about a front-lower end portion of the body 10, as illustrated, to open and close the cooking chamber 20. A handle 52 is provided on an upper portion of the door 50 to allow a user to easily operate the door 50 when opening and closing the cooking chamber 20.

The conventional electronic oven further includes a control panel 60 on a front-upper portion of the body 10. The control panel 60 includes operating knobs 62 for operating the electric oven 1 and a display 64 for displaying the operating states of the electric oven 1. A device compartment 70 is provided on a rear side of the control panel 60, above the cooking chamber 20. The device compartment 70 houses electronic components such as a magnetron, a high-voltage transformer, and a fan assembly necessary for operating the electric oven 1.

FIG. 2 illustrates a perspective view of a convection cover 80 provided in the cooking chamber of a conventional electric oven, for example, the conventional electric oven illustrated in FIG. 1. FIG. 3 illustrates a plane view of the convection cover 80, as seen from the top. The corresponding air circulation in the cooking chamber of the conventional electric oven shown in FIG. 2 is also shown. FIG. 4 illustrates a perspective view of another convection cover provided in a cooking chamber of a conventional electric oven. FIG. 5 illustrates a plane view, as seen from the top. The corresponding air circulation in the cooking chamber of the electric oven shown in FIG. 4 is also illustrated.

As shown in FIGS. 2 to 5, a convection cover 80 is provided on an inner rear side of the body 10, that is, on a rear side of the cooking chamber 20. A convection heater 94 and a convection fan 98 are both covered by the convection cover 80.

The convection heater 94 generates heat, when power is applied, to heat the air in the oven. The convection fan 98 draws air through the convection cover in the direction of the convection heater 94, then directs the air past the convection heater 95, and circulates the now heated air back into the cooking chamber 20.

The convection cover 80 typically has a round shape as shown in FIG. 2, or a rectangular shape as shown in FIG. 4. A plurality of intake holes 82 are formed on a center portion of the convection cover 80 to allow the air to pass there-through by the drawing force generated by the convection fan 98. Outlet openings 84 are formed at or near the periphery of the convection cover 80 and exhaust the air that has been heated by the convection heater 94.

FIGS. 3 and 5 illustrate the air circulated in the cooking chamber 20, as a result of the corresponding convection cover 80, the convection heater 94, and the convection fan 98. As shown, when the convection fan 98 is turned on, the air in the cooking chamber 20 is drawn through the intake holes 82 in the convection cover 80 in the direction of the convection heater 94. The air is then heated as it passes by the convection heater 94. The heated air is then exhausted through the outlet openings formed at or near the periphery of the convection cover 80 and circulated back into the cooking chamber 20.

However, the air circulated back into the cooking chamber 20 through the outlet openings 84 in the convection cover 80, as shown for example in FIG. 2, does not uniformly circulate throughout the cooking chamber 20, and in particular, the region of the cooking chamber 20 that is near the door 50. This is illustrated as a dead zone in FIG. 3. Similarly, as shown in FIG. 5, the air circulation in the cooking chamber 20 also does not uniformly circulate throughout the cooking chamber 20, resulting in two dead zones, as illustrated.

As described above, the air circulation in the cooking chamber of a conventional electric oven is not uniform throughout the cooking chamber. This results in dead zones. These dead zones, in turn, cause heat to be unevenly transferred to the food in the cooking chamber, which adversely affects the cooking process.

SUMMARY OF THE INVENTION

The present invention is directed to an electric oven that substantially obviates one or more problems due to the aforementioned and other limitations and disadvantages associated with the related art. In general, this is achieved by a convection cover formed with a sub-outlet formed therein, wherein heated air exhausted from the sub-outlet of the convection cover to a cooking chamber of the electric oven uniformly circulates throughout the cooking chamber to evenly transfer heat to food in the cooking chamber to obtain more favorable cooking results.

In accordance with one aspect of the present invention, the above-identified and other objectives are achieved by an electric oven that includes a body forming a cooking chamber. The oven further comprises a convection heater provided on an inner wall of the cooking chamber, a convection fan configured to draw air past the convection heater and circulate the heated air throughout the cooking chamber, the convection fan provided on the inner wall of the cooking chamber; and a convection cover at least partially covering the convection heater and the convection fan. The convection cover, in turn, comprises one or more intake holes through which the convection fan draws the air from the cooking chamber towards the convection heater, a main outlet including one or more openings through the convection cover, the one or more main outlet openings located at or substantially at the periphery of the convection cover, and a sub-outlet including one or more openings through the convection cover, the one or more sub-outlet openings centrally located on the convection cover relative to the main outlet.

Additional advantages, aspects, and features of the invention will be set forth in part in the description which follows and in part will become apparent to those having ordinary skill in the art upon examination of the following or may be learned from practicing the invention.

BRIEF DESCRIPTION OF THE DRAWINGS

The accompanying drawings, which are included to provide a further understanding of the invention and are incorporated in and constitute a part of this application, illustrate exemplary implementations of the invention and together with the description serve to explain the principle of the invention.

FIG. 1 illustrates a perspective view of a conventional electric oven;

FIG. 2 illustrates a perspective view of a convection cover provided in a cooking chamber of a conventional electric oven;

FIG. 3 illustrates a plane view, as seen from the top of the convection cover of FIG. 2, and the corresponding air circulation in the cooking chamber of the electric oven;

FIG. 4 illustrates a perspective view of an alternative convection cover provided in the cooking chamber of a conventional electric oven;

FIG. 5 illustrates a plane view, as seen from the top of the convection cover of FIG. 4, and the corresponding air circulation in the cooking chamber of the electric oven;

FIG. 6 illustrates a perspective view of a convection cover provided in a cooking chamber of an electric oven according to a first exemplary implementation of the present invention;

FIG. 7 illustrates a plane view of the convection cover of FIG. 6, as seen from the top of the convection cover of FIG. 6, and the corresponding air circulation in the cooking chamber of the electric oven;

FIG. 8 illustrates a perspective view of a convection cover provided in a cooking chamber of an electric oven according to a second exemplary implementation of the present invention;

FIG. 9 illustrates a plane view of the convection cover of FIG. 8, as seen from the top, and the corresponding air circulation in the cooking chamber of the electric oven;

FIG. 10 illustrates a front view of a convection cover according to a third exemplary implementation of the present invention;

FIG. 11 illustrates a perspective view of a convection cover provided in a cooking chamber of an electric oven according to a fourth exemplary implementation of the present invention;

FIG. 12 illustrates a plane view of the convection cover of FIG. 11, as seen from the top, and the corresponding air circulation in the cooking chamber of the electric oven; and FIG. 13 is a plane view of a convection cover and a radiating heater, and the corresponding illumination of the cooking chamber by the light that is emitted by the radiating heater.

DETAILED DESCRIPTION OF THE EXEMPLARY IMPLEMENTATIONS

Reference will now be made in detail to the exemplary implementations of the present invention, examples of which are illustrated in the accompanying drawings. The invention may, however, be embodied in many different forms and should not be construed as being limited to the implementations set forth herein. Rather, these implementations are provided so that this disclosure will be thorough and complete, and will fully convey the concept of the invention to those skilled in the art. Wherever possible, the same reference numerals will be used throughout the drawings to refer to same or like parts.

As shown in FIGS. 6 to 12, an electric oven according to exemplary implementations of the present invention includes a body 100 having a cooking chamber 150 formed therein, a door 200, a convection heater 300, a convection fan 400, and a convection cover 500. The convection cover 500 is formed with a plurality of intake holes 510, a main outlet 520, and a sub-outlet 550. The convection cover 500 may further include first air guides (i.e., air deflectors) 570 and second air guides (i.e., air deflectors) 580, as illustrated in FIGS. 11 and 12.

The cooking chamber 150 is formed in the body 100 such that there is sufficient space to accommodate food. The door 200 opens and closes the cooking chamber 150 so that the food may be placed in and retrieved from the cooking chamber 150. Although not shown, a broil heater and a bake heater may be provided in upper and lower portions of the cooking chamber 150. The body 100, the cooking chamber 150, the oven door 200, and various other components associated with the body 100 are generally known in the art. Thus, a further description thereof will be omitted.

The convection heater 300 is provided on an inner wall of the body 100, that is, on an inner wall forming the cooking chamber 150. The convection heater 300 heats the air in the cooking chamber 150 by generating heat when power is applied. The convection fan 400 is provided on the same inner wall as the convection heater 300. The fan 400 draws the air in the cooking chamber 150 through the intake holes 510 in the convection cover 300, past the convection heater 300 and then re-circulates the heated air back into and throughout the cooking chamber 150. The convection heater 300 and the convection fan 400 are generally well known in the art.

Hereinafter, the convection cover 500 will be described in detail. By forming a sub-outlet 550 in the convection cover 500, the present invention enables heated air to be uniformly circulated throughout the cooking chamber 150.

The convection cover 500 is generally positioned in front of the convection heater 300 and the convection fan 400 so that the convection heater 300 and the convection fan 400 are at least partially covered and protected. A plurality of intake holes 510 are formed through the centermost portion of the convection cover 500, as illustrated, thus allowing air in the cooking chamber 150 to be drawn by the convection fan 400 through the convection cover 500. After the air passes through the intake holes 510, the convection heater 300 heats the air. The air is then exhausted through main outlet openings 520 provided at or substantially at the periphery of the convection cover 500 and circulated back into the cooking chamber 150.

As shown in FIGS. 6 through 10, the convection cover 500, according to the present invention, is formed with a sub-outlet 550. The sub-outlet 550 is positioned such that a first portion of the heated air is re-circulated back into the cooking chamber 150 before the remaining portion of the heated air is exhausted through the main outlet openings 520. In order for the first portion of the heated air to pass through the sub-outlet 550 before the remaining portion of the heated air is exhausted through the main outlet openings 520, the sub-outlet 550 is generally positioned adjacent to the convection heater 300, though the convection heater 300 is more centrally positioned than the sub-outlet 500. With respect to the main outlet openings 520, the sub-outlet 550 is more centrally positioned.

The sub-outlet 550 illustrated in FIGS. 6 through 12 is formed in a ring-like shape, although the sub-outlet 550 may be formed in a rectangular shape, a triangular shape, or any number of other shapes. However, considering the rotation of and the radius of the convection fan 400, the sub-outlet 550 is preferably formed in a ring-like shape to more effectively exhaust the heated air. Additionally, because the sub-outlet 550 exhausts air heated by the convection heater 300 into the cooking chamber 150, the sub-outlet 550 is, as stated above, preferably formed in the convection cover 500 at a position that is outside or beyond the perimeter (e.g., diameter) of the convection heater 300 with respect to the center of the convection cover 500. That is, the convection heater 300 is more centrally located than the sub-outlet 550 relative to the center of the convection cover 500.

The sub-outlet 550 comprises one or more openings, for example, a plurality of slits 552 that penetrate the convection cover 500, as shown in FIGS. 6 and 8. Together, the slits 552 may form a ring-like shape. In FIGS. 6 and 8, the length of the slits 552 are aligned circumferentially. Although it is not shown, the length of the slits could align radially, similar to tire spokes. Alternatively, the sub-outlet openings may be a plurality of round or substantially round holes 554, where together, the holes form a ring-like shape as shown, for example, in FIG. 10. Although the openings associated with the sub-outlet 550 may take the form of various shapes other than those already mentioned, it is preferable that the openings have a simple shape to simplify the manufacturing process.

As shown in FIGS. 7, 9 and 12, the heated air passing through the sub-outlet 550 uniformly circulates throughout the cooking chamber 150. In contrast, when the main outlet 520 is the only means through which heated air is exhausted back into the cooking chamber 150, dead zones are created within the cooking chamber 150; the dead zones representing regions where the heated air does not uniformly circulate. By providing a sub-outlet 550 in the convection cover 500, heated air is exhausted through both the main outlet openings 520 and the sub-outlet 550 and uniformly circulated throughout the cooking chamber 150, thus evenly transferring heat to the food in the cooking chamber 150.

As shown in FIG. 8, the sub-outlet 550 may be formed in the convection cover 500 such that the slits 552 (or the round or substantially round holes) together form concentric ring-like shapes (i.e., a plurality of ring-like formations having different diameters). While the sub-outlet 550 shown in FIG. 8 includes two concentric ring-like formations, more than two concentric ring-like formations comprising slits 552 or round holes 554 are possible. In this manner, as shown in FIG. 9, heated air is uniformly circulated throughout the cooking chamber 150 to better and more evenly transfer heat to the food in the cooking chamber 150 and, therefore, to obtain even more favorable cooking results.

The convection heater 300 may be a radiating heater which emits light when power is applied. The sub-outlet 550 may be formed on the convection cover 500 so that it is generally adjacent to the convection heater 300 in order to allow the light emitted from the convection heater 300 to pass therethrough into the cooking chamber 150. FIG. 13 illustrates an exemplary embodiment of the present invention, where the convection heater 300 is a radiating heater. As shown, light from the radiating heater may pass through the sub-outlet 550, thereby illuminating the cooking chamber 150. Likewise, at least a portion of the air drawn past the convection heater 300 by the fan 400 also will pass through the sub-outlet 550 and into the cooking chamber 150. The radiating heater may be a halogen heater provided with a halogen lamp, a carbon heater, or other known radiating heaters that generate and emit light.

In order to direct a sufficient portion of the heated air through the sub-outlet 550, it may be desirable to provide an air deflection means to more effectively direct the heated air in a desired direction. Thus, for example, the convection cover 500 may include first air guides (or air deflectors) 570 and second air guides (i.e., air deflectors) 580, as illustrated in FIGS. 11 and 12.

As shown in FIG. 11, the convection cover 500 includes second air guides that protrude from a front side of the convection cover 500 into the cooking chamber 150 in the general direction of the door 200, and at a predetermined angle to better guide and circulate the heated air passing through the sub-outlet 550. Here, the portion of the heated air passing through the sub-outlet 550 passes into the cooking chamber 150 in a predetermined direction based on the predetermined angle of the second air guides 580. In the exemplary embodiment illustrated in FIGS. 11 and 12, the second air guides 580 have a rib-like shape that follows the shape of the slits 552.

As shown in FIG. 12, the convection cover 500 may also include first air guides 570 that protrude rearward into the space behind the convection cover 500, and at a predetermined angle to better guide a portion of the heated air through the sub-outlet 550. In the exemplary embodiment illustrated in FIGS. 11 and 12, the shape of the first air guides 570 is substantially similar to the shape of the second air guides 580. However, as stated, the first air guides 570 differ from the second air guides 580 in that the first air guides project in a generally rearward direction, whereas the second air guides 580 project in a generally forward direction.

Again referring to FIG. 12, the convection cover 500 may further include an air guide or guides (i.e., an air deflection structure or structures) 585 associated with the main outlet openings 520. These air guides or deflectors may included to better direct and circulate the heated air that passes through the main outlet openings 520. In FIG. 12, multiple air guides 585 associated with the main outlet openings 520 are show. However, it will be appreciated by those skilled in the art that more than or fewer than those illustrated in FIG. 12 may be employed.

As described above, an electric oven having a convection cover formed with a sub-outlet, according to the present invention, makes it possible to evenly transfer heat to food in the cooking chamber by uniformly circulating the heated air throughout the cooking chamber via a sub-outlet, thus providing more favorable cooking results.

Additionally, when a radiating heater is used as the convection heater, the light generated from the radiating heater can pass through the sub-outlet of the convection cover thus increasing the light that radiates into the cooking chamber, which makes it easier to visually check the cooking status of the food.

Moreover, the first air guides associated with the sub-outlet of the convection cover effectively guide a sufficient amount of the heated air towards and through the sub-outlet, while the second air guides direct that air into the cooking chamber in a predetermined direction to uniformly circulate the heated air throughout the cooking chamber.

It will be apparent to those skilled in the art that various modifications and variations can be made in the present invention. Thus, it is intended that the present invention covers such modifications and variations of the invention.

What is claimed is:

1. An electric oven comprising:

a body forming a cooking chamber;

a convection heater provided on an inner wall of the cooking chamber;

a convection fan configured to draw air past the convection heater and circulate the heated air throughout the cooking chamber, the convection fan provided on the inner wall of the cooking chamber; and a convection cover at least partially covering the convection heater and the convection fan, wherein the convection cover comprises:

at least one air guide, one or more intake holes through which the convection fan draws the air from the cooking chamber towards the convection heater, a main outlet including one or more openings through the convection cover, the one or more main outlet openings located at or substantially at a periphery of the convection cover, and a sub-outlet including one or more openings through the convection cover, the one or more sub-outlet openings centrally located on the convection cover relative to the main outlet, wherein the sub-outlet is located on the convection cover adjacent to the convection heater relative to the main outlet, such that a portion of the air passing the convection heater in the direction of the main outlet will pass through the sub-outlet, wherein the convection heater is located in back of the convection cover and the cooking space is located in front of the convection cover, and wherein the at least one air guide protrudes towards a space in back of the convection cover, and wherein the at least one air guide is configured to direct a portion of the heated air from the space behind the convection cover through the one or more sub-outlet openings.

2. The electric oven according to claim 1, wherein the sub-outlet openings comprise a plurality of slits.

3. The electric oven according to claim 2, wherein the length of the sub-outlet openings are aligned in a radial orientation.

4. The electric oven according to claim 2, wherein the length of the sub-outlet openings are aligned in a circumferential orientation.

5. The electric oven according to claim 1, wherein the sub-outlet openings comprise a plurality of round or substantially round holes.

6. The electric oven according to claim 1, wherein the sub-outlet openings are arranged in a ring-like formation.

7. The electric oven according to claim 1, wherein the sub-outlet openings are arranged in concentric ring-like formations.

8. The electric oven according to claim 1, wherein the convection heater is a radiating heater, and wherein the sub-outlet is positioned such that light radiating from the radiating heater is capable of passing through the convection cover into the cooking chamber.

9. The electric oven according to claim 8, wherein the radiating heater is a halogen lamp heater.

10. The electric oven according to claim 8, wherein the radiating heater is a carbon-type infrared heater.

11. The electric oven according to claim 1, wherein the at least one air guide protrudes towards the cooking chamber, and wherein the at least one air guide is configured to direct the heated air passing through the one or more sub-outlet openings into the cooking chamber.

12. The electric oven according to claim 11, wherein the at least one air guide is configured to direct the air into the cooking chamber in a predetermined direction.

13. The electric oven according to claim 1, wherein the at least one air guide is associated with the main outlet openings.

14. The electric oven according to claim 13, wherein the at least one air guide is configured to direct heated air through the main outlet openings and into the cooking chamber.

* * * * *